US007594416B2

(12) United States Patent
Bosin

(10) Patent No.: US 7,594,416 B2
(45) Date of Patent: Sep. 29, 2009

(54) SECURITY DEVICE AND METHODOLOGY

(76) Inventor: Sandford Bosin, 71 Stratford Rd., East Brunswick, NJ (US) 08816

( * ) Notice: Subject to any disclaimer, the term of this patent is extended or adjusted under 35 U.S.C. 154(b) by 944 days.

(21) Appl. No.: 11/087,633

(22) Filed: Mar. 24, 2005

(65) Prior Publication Data

US 2006/0213243 A1 Sep. 28, 2006

(51) Int. Cl.
*E05B 41/00* (2006.01)

(52) U.S. Cl. ..... 70/432; 70/24; 70/435; 70/441; 340/542

(58) Field of Classification Search ..... 70/20–49, 70/432, 435, 437–439, 441, 209, 270, DIG. 49; 340/540, 542
See application file for complete search history.

(56) References Cited

U.S. PATENT DOCUMENTS 3,622,978 A * 11/1971 Lipschutz ..... 340/457
3,993,987 A * 11/1976 Stevens ..... 340/542
4,367,455 A * 1/1983 Fried ..... 340/310.11
4,556,872 A * 12/1985 Masoncup et al. ..... 340/542
4,811,578 A * 3/1989 Masoncup et al. ..... 70/38 B
5,194,845 A * 3/1993 Sirmon et al. ..... 340/427
5,587,702 A * 12/1996 Chadfield ..... 340/542
5,598,725 A * 2/1997 Chang ..... 70/209
5,600,979 A * 2/1997 Winner et al. ..... 70/252
5,663,704 A * 9/1997 Allen et al. ..... 340/426.25
5,765,414 A * 6/1998 Yu ..... 70/209
5,774,058 A * 6/1998 Henry et al. ..... 340/5.5
5,877,686 A * 3/1999 Ibey et al. ..... 340/571
5,915,558 A * 6/1999 Girvetz ..... 206/534
6,029,481 A * 2/2000 Lai ..... 70/25
6,035,672 A * 3/2000 Lai ..... 70/25
6,116,062 A * 9/2000 Markegard et al. ..... 70/19
6,199,415 B1 * 3/2001 Markegard et al. ..... 70/209
6,348,857 B1 * 2/2002 Hsu ..... 340/426.28
6,474,116 B1 * 11/2002 Lai ..... 70/25
6,734,788 B1 * 5/2004 Winner ..... 340/426.1

* cited by examiner

*Primary Examiner*—Suzanne D Barrett
(74) *Attorney, Agent, or Firm*—Merchant & Gould, P.C.; Raymond Van Dyke

(57) ABSTRACT

A lock having a body, a face, a shackle and an audio and/or a visual system. The audio system includes a speaker system and a controller, and the visual system includes an indicator light and a controller. The systems also employ a battery and a battery indicator light, e.g., an LED, indicating when the battery needs to be replaced. The audio system emits an audible sequence and the visual system emits a light sequence when the lock is unlocked, reminding a user to lock the lock.

20 Claims, 2 Drawing Sheets

SECURITY DEVICE AND METHODOLOGY

FIELD OF THE INVENTION

The present invention relates to locks and more particularly to a combination lock that includes an indicator when the lock is left open or unlocked.

BACKGROUND OF THE INVENTION

Locks, for example, combination locks are well known, and are widely used in various occasions to provide safety protection for goods and properties. At present there are many different types of portable locks available on the market, chiefly combination locks. One major drawback of prior and existing locks, however, is that a user may forget to lock the lock. This inherent problem in the usage of locks has not been adequately addressed by the prior art. Thus, it is desirable to provide a lock that includes an indicator that informs the user when the lock is left open or unlocked.

SUMMARY OF THE INVENTION

The present invention is a lock having a body, a face, a shackle, and an audio or visual system. The audio system includes a speaker system and a controller, and the visual system includes an indicator light and a controller. The systems also employ a battery and a battery indicator light, e.g., an LED, indicating when the battery needs to be replaced. The audio system emits an audible sequence and the visual system emits a light sequence when the lock is unlocked, reminding a user to lock the lock.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE INVENTION

The following detailed description is presented to enable any person skilled in the art to make and use the invention. For purposes of explanation, specific nomenclature is set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

Figure 1:
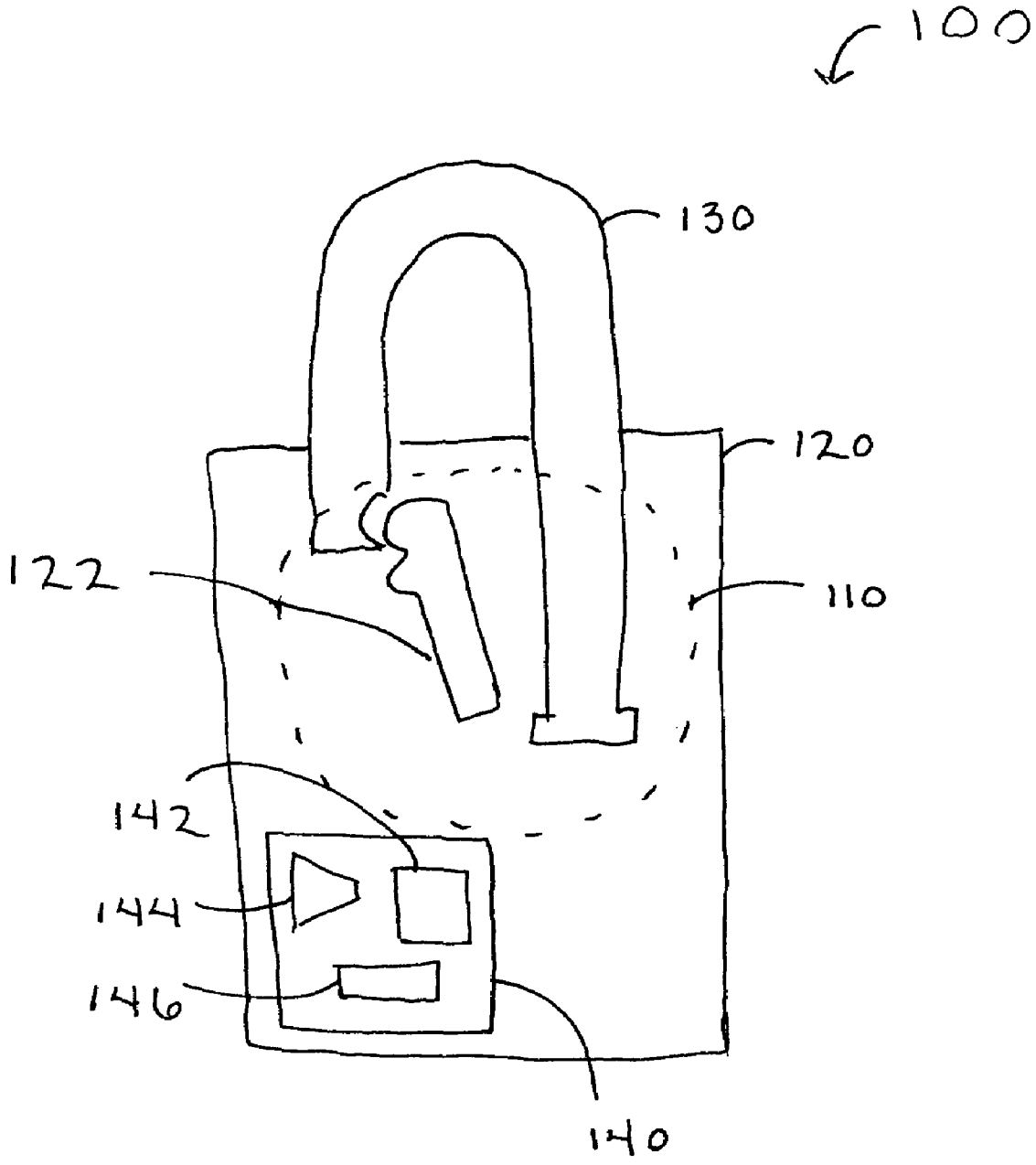
FIG. 1 is an internal view of the combination lock of the present invention.

A combination lock is shown in FIG. 1, and generally designated with the reference numeral 100. The combination lock 100 is of a typical combination lock design, as is known in the art. For example, the combination lock 100 has a wheel face 110, a body 120, and a shackle 130, as is known in the art. The body 120 includes cams 122 that engage the shackle 130, allowing the combination lock 100 to lock and unlock, as is understood in the art. Additionally, the combination lock 100 has an audio system 140. The audio system 140 includes a battery 142, e.g., a nickel-cadmium battery, that powers a speaker system 144. The speaker system 144 is controlled by a controller 146. The controller 146 communicates with the shackle 130.

During the operation of the present invention, when the shackle 130 is in an open position, i.e., when the combination lock 100 is unlocked, the controller 146 directs the speaker system 144 to emit an audible sequence. An exemplary audible sequence would be three beeps or chirps in rapid succession repeated every thirty seconds. When the shackle 130 is in the closed position, i.e., when the combination lock 100 is locked, as illustrated in FIG. 1, the controller 146 would direct the speaker system 144 to remain silent. In this fashion, users of such locks, whether in gyms, storage areas or in any other usage, would readily know the status of their lock and better assure the protection of their possessions It should be understood that the audio system 140 can emit a sound, e.g., a tone, to alert the user of the opened status of the lock or employ a number of sounds and/or tones, e.g., repeating a sound or tone periodically, varying the sound or tone by frequency, volume or other discernable means, increasing the sound or tone in intensity as long as the locking mechanism is unlocked, and other patterns, e.g., the aforementioned three beeps.

Figure 2:
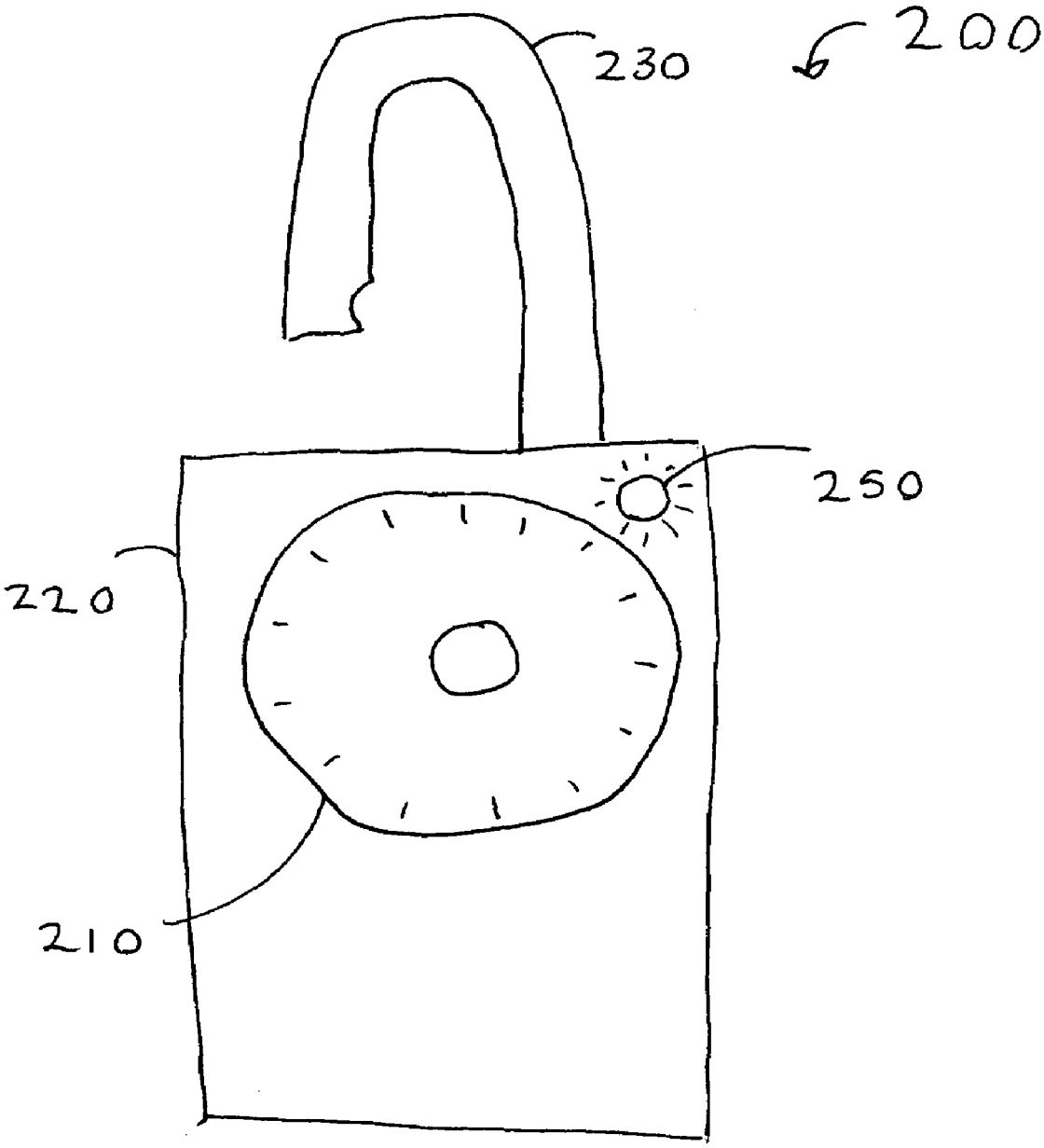
FIG. 2 is a front view of the combination lock of the present invention.

With respect now to FIG. 2, there is shown therein another embodiment of the present invention, generally designated by the reference numeral 200. As discussed above in connection with FIG. 1, the combination lock 200 may be a typical combination lock with the aforementioned constituent parts, including a wheel face 210, a body 220 and a shackle 230, as is known in the art, or any other locking mechanisms, e.g., a key lock or other conventional or high-tech security devices, e.g., a biometric mechanism with a lock component. Additionally, the combination lock 200 in this embodiment has an indicator light 250. It should be understood that indicator light 250 may be an LED or another light that indicates a low battery charge.

The combination locks 100 and 200 with the indicators may be used in numerous applications, e.g., to lock a tool shed, a tool box, a school locker, a gym locker, etc. The indicator sound or light indicates when the lock 100/200 is open or unlocked, thus reminding a user to lock the combination lock. Additionally, the battery indicator light 250 indicates when the battery 142 requires replacement.

It should be understood that the indicator light 250 or any other visual or light system employed in the instant invention can emit a constant or flashing beam of light to alert the user of the opened status of the lock. The light source, when activated, can emit a continuous light of a given intensity, vary the intensity, e.g., increase intensity as long as the locking mechanism is unlocked, employ a number of light sources, each emitting respective visual signals which may differ in color in intensity, and other patterns.

It should be understood that the principles of the present invention can be employed in combination, e.g., the locking mechanism can have both an audio system and a visual system to alert and user of the opened status of the lock. The light source in such an embodiment could serve as a constant reminder of the lock status and the audio source chiming in at periodic intervals to further alert the user. Usage of two alert mechanisms is preferred since forgetful individuals may require additional reminders.

Additional alert mechanisms include a vibratory device to start vibrating upon unlocking the lock or at a time interval afterwards. Since the vibrating sensation must normally be perceived by touch or close physical contact between the user and the lock, vibrations alone would not normally be enough. However, vibrations could generate sounds that would alert the user, thereby serving the overall function.

The foregoing description of the present invention provides illustration and description, but is not intended to be exhaustive or to limit the invention to the precise one disclosed. Modifications and variations are possible consistent with the above teachings or may be acquired from practice of the invention. Thus, it is noted that the scope of the invention is defined by the claims and their equivalents.

What is claimed is:

1. A lock comprising:

a padlock locking mechanism; and an indicator, said indicator being activated when said locking mechanism is unlocked, and said indicator being deactivated when said locking mechanism is locked, wherein a user of said lock is alerted to the unlocked status of said locking mechanism by a signal from said indicator, and wherein the continued unlocked status of said locking mechanism causes generation, by said indicator, of a second signal.

2. The lock according to claim 1, wherein said indicator is an audio system, wherein said indicator emits an audible signal when said locking mechanism is unlocked, and said audible signal is deactivated when said locking mechanism is locked.

3. The lock according to claim 2, wherein said audio system comprises;

a speaker; and a controller, wherein said speaker emits said audible signal when said locking mechanism is unlocked, and, upon locking of the locking mechanism, said controller instructs said speaker to cease said audible signal.

4. The lock according to claim 2, wherein said audible signal is a tone.

5. The lock according to claim 4, wherein said audible signal comprises a plurality of tones, said plurality of tones capable of differing from each other.

6. The lock according to claim 2, wherein said audible signal is repeated periodically.

7. The lock according to claim 2, wherein the volume of said audible signal varies.

8. The lock according to claim 7, wherein the volume of said audible signal increases as long as the locking mechanism is unlocked.

9. The lock according to claim 1, wherein said indicator is a light system, wherein said indicator emits a visual signal when said locking mechanism is unlocked, and said visual signal is deactivated when said locking mechanism is locked.

10. The lock according to claim 9, wherein said light system comprises:

an indicator light; and a controller, wherein said indicator light emits said visual signal when said locking mechanism is unlocked, and, upon locking of the locking mechanism, said controller instructs said indicator light to cease said visual signal.

11. The lock according to claim 9, wherein said visual signal is a continuous light.

12. The lock according to claim 9, wherein said visual signal comprises a flashing signal repeated periodically.

13. The lock according to claim 9, wherein the intensity of said visual signal varies.

14. The lock according to claim 13, wherein the intensity of said visual signal increases as long as the locking mechanism is unlocked.

15. The lock according to claim 9, wherein said visual signal comprises a plurality of lights.

16. The lock according to claim 15, wherein said plurality of lights emit respective visual signals, said respective visual signals capable of differing in color or intensity.

17. The lock according to claim 9, wherein said visual signal comprises a light varying in color or intensity.

18. The lock according to claim 1, wherein said indicator is a vibratory device.

19. The lock according to claim 1, wherein said lock is a combination lock.

20. A method for securing an object for a user comprising:

locking said object using a lock, said lock including an indicator;

alerting said user, by a first signal from said indicator upon said lock being unlocked, of the unlocked status of said lock, said indicator being disabled upon said lock then being locked, wherein the user of said object is alerted to the unlocked status of the object by said first signal from said indicator; and further alerting said user, by a second signal from said indicator after said first signal, of the unlocked status of said object; wherein said lock is a padlock.

* * * * *

UNITED STATES PATENT AND TRADEMARK OFFICE

CERTIFICATE OF CORRECTION

PATENT NO. : 7,594,416 B2
APPLICATION NO. : 11/087633
DATED : September 29, 2009
INVENTOR(S) : Sanford Bosin It is certified that error appears in the above-identified patent and that said Letters Patent is hereby corrected as shown below:

Title Page,

Item (76) should read:

Inventor: --Sanford Bosin, Regency at Monroe, 52 Riviera Drive, Monroe Township, NJ (US) 08831--

Signed and Sealed this

Tenth Day of November, 2009

David J. Kappos

David J. Kappos
*Director of the United States Patent and Trademark Office*